US010300722B2

(12) United States Patent
Francke et al.

(10) Patent No.: US 10,300,722 B2
(45) Date of Patent: May 28, 2019

(54) DOOR TO ROTATE TO PROVIDE ACCESS

(71) Applicant: HEWLETT-PACKARD DEVELOPMENT COMPANY, L.P., Houston, TX (US)

(72) Inventors: Justin Francke, San Diego, CA (US); Erich Coiner, San Diego, CA (US)

(73) Assignee: Hewlett-Packard Development Company, LP., Spring, TX (US)

( * ) Notice: Subject to any disclaimer, the term of this patent is extended or adjusted under 35 U.S.C. 154(b) by 139 days.

(21) Appl. No.: 15/507,758

(22) PCT Filed: Aug. 28, 2014

(86) PCT No.: PCT/US2014/053098
§ 371 (c)(1),
(2) Date: Feb. 28, 2017

(87) PCT Pub. No.: WO2016/032476
PCT Pub. Date: Mar. 3, 2016

(65) Prior Publication Data
US 2017/0282616 A1 Oct. 5, 2017

(51) Int. Cl.
*B41J 29/13* (2006.01)

(52) U.S. Cl.
CPC ..... *B41J 29/13* (2013.01)

(58) Field of Classification Search
CPC . B41J 29/00; B41J 29/12; B41J 29/13; G06K 17/00; H01M 2/10; H05K 5/03
See application file for complete search history.

(56) References Cited

U.S. PATENT DOCUMENTS 2,492,025 A * 12/1949 Zecher ..... E05G 1/005 109/46
4,801,172 A * 1/1989 Townsend ..... B60J 5/06 296/146.6
4,885,219 A 12/1989 Miller
9,574,778 B2 * 2/2017 Woods ..... F24C 15/026
2002/0189348 A1 * 12/2002 Badiali ..... H05K 5/0017 73/431

FOREIGN PATENT DOCUMENTS

| | | |
|---|---|---|
| JP | 2005059228 | 3/2005 |
| JP | 2006202972 | 8/2006 |
| JP | 2007329241 | 12/2007 |
| WO | WO-2014117830 | 8/2014 |

* cited by examiner

*Primary Examiner* — Nguyen Q. Ha
(74) *Attorney, Agent, or Firm* — HP Inc. Patent Department

(57) ABSTRACT

An access device includes a door. The door is rotatable between a closed position and an open position. In the closed position, the door covers an access opening of a compartment of a main body of the electronic device. In the open position, the door uncovers the access opening of the compartment to enable a user to access an inside of the compartment. The door including at least one connector to movably connect to the main body to enable the door to rotate about a central axis thereof. The door resides within the compartment in the open position and the closed position.

11 Claims, 8 Drawing Sheets

DOOR TO ROTATE TO PROVIDE ACCESS

BACKGROUND

Access devices are included in electronic apparatuses having compartments. Access devices include movable doors to move between a closed position and an open position. In the closed position, the door blocks access to the compartment. In the open position, the door unblocks access to the compartment. Thus, in the open position, a user may access contents inside of the compartment.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Access devices are included in electronic apparatuses such as printing apparatuses having compartments. Access devices include movable doors to move between a closed position in which access to the compartment is blocked and an open position in which access to the compartment is unblocked (e.g., granted). Thus, in the open position, a user may access contents inside of the compartment. In the open position and/or closed position, however, the door and/or a portion thereof may be exposed outside of the compartment. Subsequently, a user or object may inadvertently impact the door and, potentially, cause it to break and/or misalign. Further, the movement of the door between an open position and a closed position about a non-central axis of the door such as about a side edge, bottom or top of the door may not provide sufficient cam action upon closing of the door in the closed position. Thus, the access devices including doors placed outside of a respective compartment in the closed position and/or open position may be susceptible to damage.

In examples, an access device is usable with an electronic device such as a printing apparatus. The access device includes a door rotatable between a closed position and an open position. In the closed position, the door covers an access opening of a compartment of a main body of the electronic device. In an open position, the door uncovers the access opening of the compartment to enable a user to access an inside of the compartment. The door includes at least one connector to movably connect to the main body to enable the door to rotate about a central axis thereof, rather than about a bottom, top, or side edge of the door. Consequently, a revolving aspect to door about the central axis provides sufficient cam action right upon closing the door in the closed position. Further, the door resides within the compartment in the open position and the closed position. Thus, events such as the door receiving an inadvertent impact, receiving damage, and being misaligned may be reduced.

Figure 1:
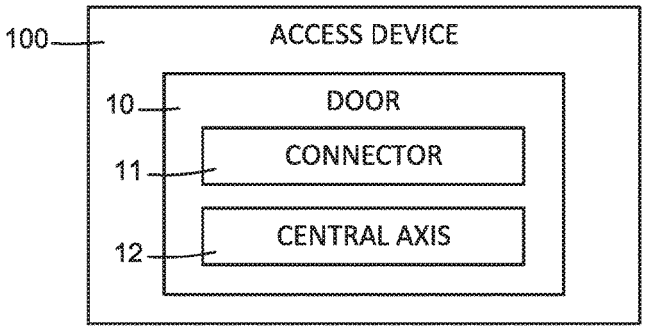
FIG. 1 is a block diagram illustrating an access device according to an example.

FIG. 1 is a block diagram illustrating an access device according to an example. The access device 100 is usable with an electronic device. Referring to FIG. 1, the access device 100 includes a door 10. The door 10 is rotatable between a closed position and an open position. In the closed position, the door 10 covers an access opening of a compartment of a main body of the electronic device. In the open position, the door 10 uncovers the access opening of the compartment to enable a user to access an inside of the compartment. For example, the user may access an electrical connector such as a card slot through the compartment to receive the electronic card such as a memory device. That is, a port to the electrical connector may be accessed through the compartment in which the electrical connector may be proximate thereto. For example, the electrical connector may be position in or adjacent to the compartment. Referring to FIG. 1, the door 10 includes at least one connector 11 to movably connect to the main body to enable the door 10 to rotate about a central axis 12 thereof. The door 10 resides within the compartment in the open position and the closed position. In some examples, the door 10, in its entirety, resides in the compartment in the closed position and the open position. The access opening is part of the inside of the compartment.

Figure 2:
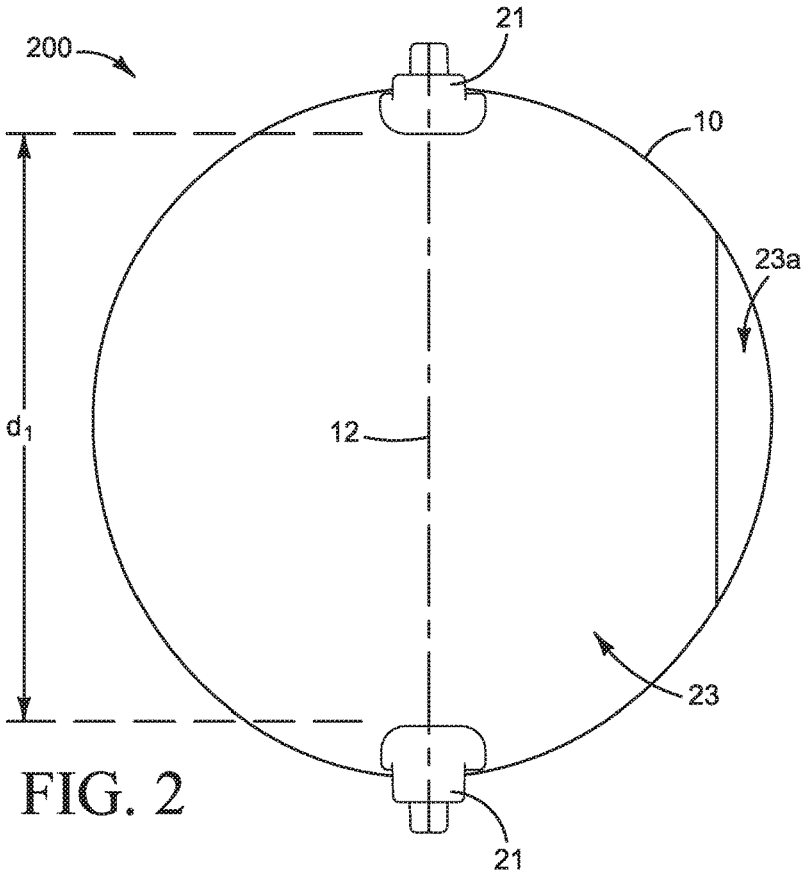
FIG. 2 is a rear view illustrating a door of an access device according to an example.
Figure 3:
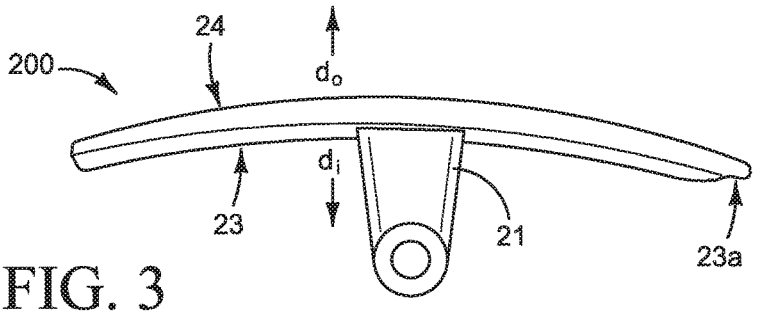
FIG. 3 is a cross-sectional view illustrating the access device of FIG. 2 according to an example.
Figure 4:
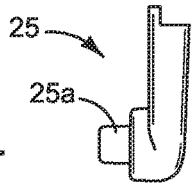
FIG. 4 is a side view illustrating a connector of the access device of FIG. 2 according to an example.

FIG. 2 is a rear view illustrating a door of an access device according to an example. FIG. 3 is a side view illustrating the access device of FIG. 2 according to an example. FIG. 4 is a side view illustrating a connector of the access device of FIG. 2 according to an example. The access device 200 is usable with an electronic device. In some examples, the access device 200 may include the door 10 as previously discussed with respect to the access device 100 of FIG. 1. Referring to FIGS. 2-4, in some examples, the door 10 includes a circular shape having a central axis 12 disposed along a diameter of the door 10. The door 10 includes an inner surface 23 and an outer surface 24. For example, the inner surface 23 may have a concave shape to face inwards $d_i$ toward a compartment of a main body of the electronic device in the closed position. Additionally, in some examples, the outer surface 24 may have a convex shape to face outwards $d_o$ away from the compartment in the closed position.

Referring to FIGS. 2-4, in some examples, the door 10 includes a plurality of connectors 21. The plurality of connectors 21 may extend from an inner surface 23 of the door 10 and be spaced apart from each other. Each connector 21 may be in a form of an angled member 25 such as an L-shaped member. The angled member 25 (FIG. 4) may extend away from the inner surface 23 of the door 10. Additionally, the angled member 25 may include an end 25*a* to insert into a respective hole of the main body. For example, the end 25*a* may be a projection that is inserted into and moves within a corresponding hole of the main body. That is, the end 25*a* may rotate within the respective hole in response to a rotation of the door 10 between the open position and the closed position.

Referring to FIGS. 2-4, in some examples, the connectors 21 may be disposed on the inner surface 23 of the door 10 to movably connect to the main body and be spaced apart from each other by a distance $d_1$ about equal to a diameter of the door 10. That is, the connectors 21 may be located proximate to a circumference of the door 10 and by opposite ends of the inner surface 23. The arrangement and movable connection of the connectors 21 to the main body, enable the door 10 to rotate about a central axis 12 along a diameter of the door 10. Consequently, in some examples, a revolving aspect of the door 10 about the central axis 12 provides sufficient cam action right upon a closing of the door 10 to the main body in the closed position. In some examples, the central axis 12 may correspond with an apex of the outer surface 24 of the door 10. In some examples, the plurality of connectors 21 may be removable from the main body.

Referring to FIGS. 2-4, in some example, the inner surface 23 may also include a stop region 23*a* to contact a corresponding stop portion of the main body in the closed position. In some examples, the stop region 23*a* may be offset and/or recessed with respect to other sections of the inner surface 23 of the door 10. For example, a thickness of the stop region 23*a* may be thinner than a thickness of other sections of the door 10. Thus, the outer surface 23 of the door may be flush with an outer surface of the main body in response to contact between the stop region 23*a* and the stop portion in the closed position. That is, in a flush arrangement between the door 10 and the main body, the shape of the main body may be continued across the outer surface 24 of the door 10. For example, the transition between the outer surfaces of the main body and door 10 along the electronic device is smooth.

Figure 5:
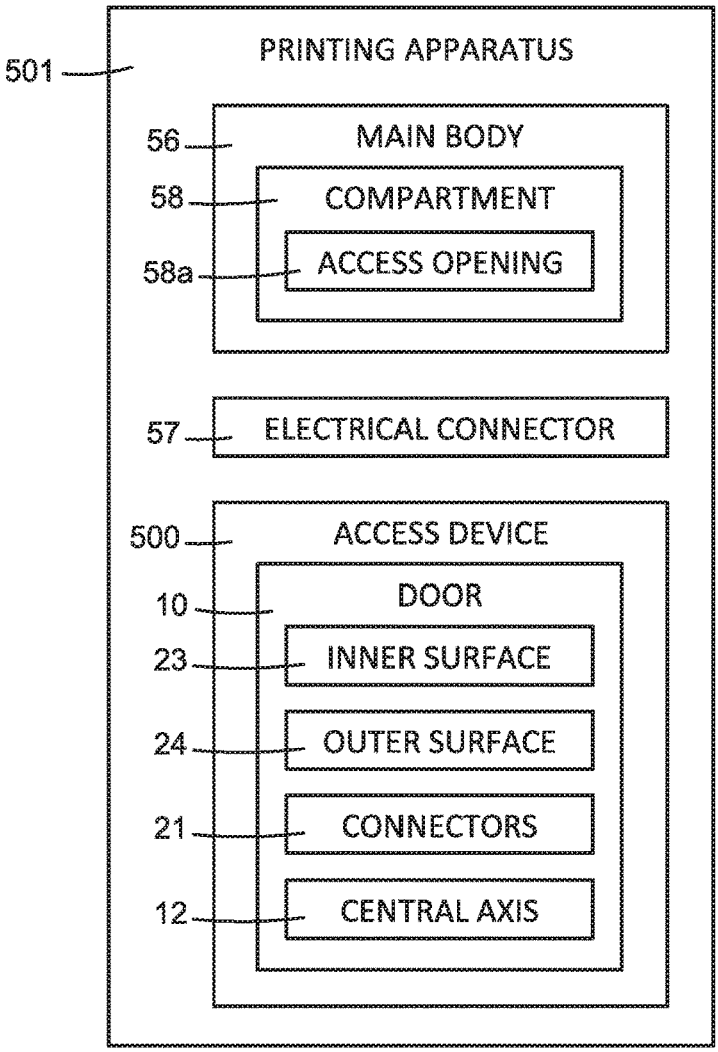
FIG. 5 is a block diagram illustrating a printing apparatus according to an example.

FIG. 5 is a block diagram illustrating a printing apparatus according to an example. Referring to FIG. 5, a printing apparatus 501 includes a main body 56, an electrical connector 57, and an access device 500. The main body 56 includes a compartment 58 having an access opening 58*a*. The electrical connector 57 is disposed proximate to the compartment 58 to receive an electronic device by a user. That is, a port to the electrical connector 57 may be accessed through the compartment 58. The access device 500 includes a door 10 having a circular shape. The door 10 is rotatable between a closed position and an open position to enable a user to access the electrical connector 57. That is, in the closed position, the door 10 covers the access opening 58*a* of the compartment 58. Additionally, in the open position, the door 10 uncovers the access opening 58*a* of the compartment 58.

Referring to FIG. 5, the door 10 includes an inner surface 23, an outer surface 24, and a plurality of connectors 21. For example, the inner surface 23 has a concave shape to face inwards toward the compartment 58 in the closed position. The outer surface 24, for example, has a convex shape to face outwards away from the compartment 58 in the closed position. The connectors 21 movably connect to the main body 56 to enable the door 10 to rotate about a central axis 12 thereof corresponding to a diameter of the door 10. Further, the door 10 resides within the compartment 58 in the open position and the closed position.

Figure 6:
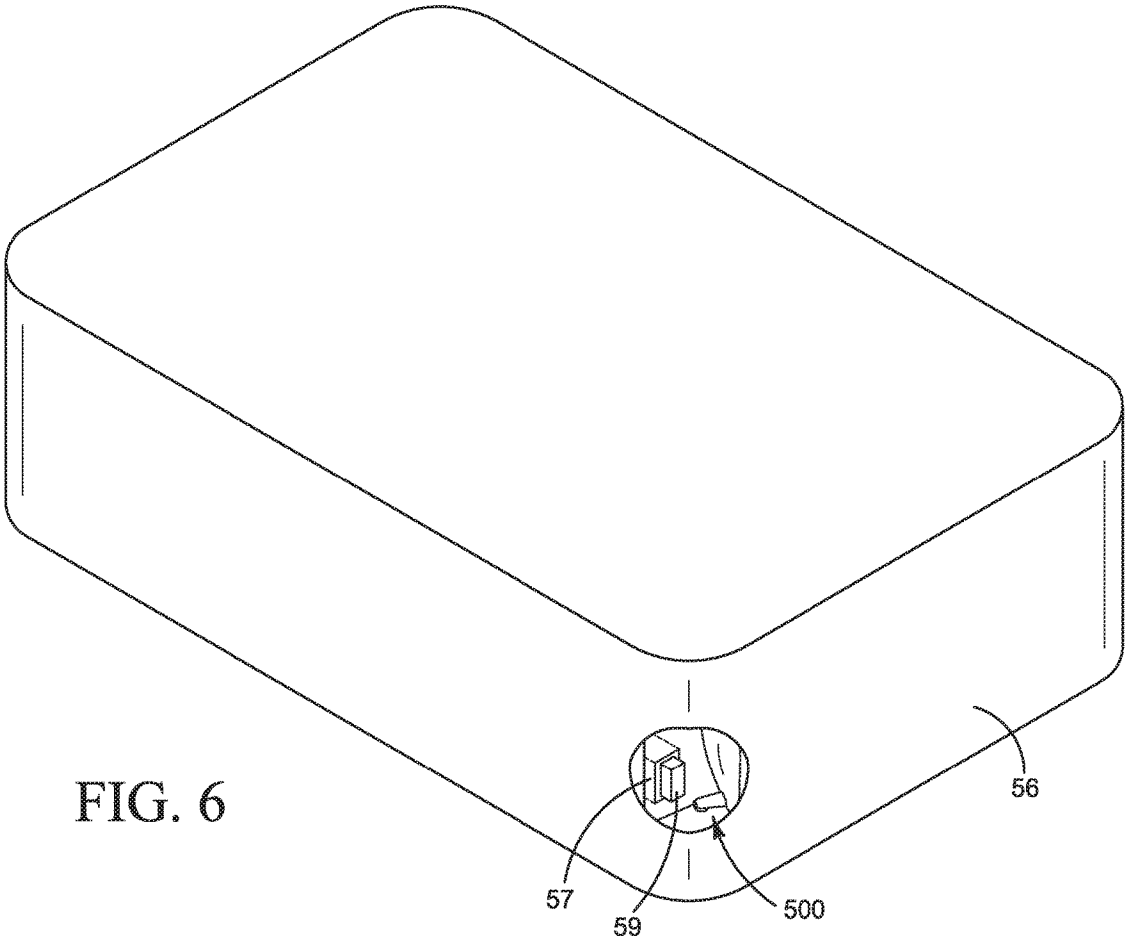
FIG. 6 is perspective view illustrating a printing apparatus including a door in an open position according to an example.
Figure 7A:
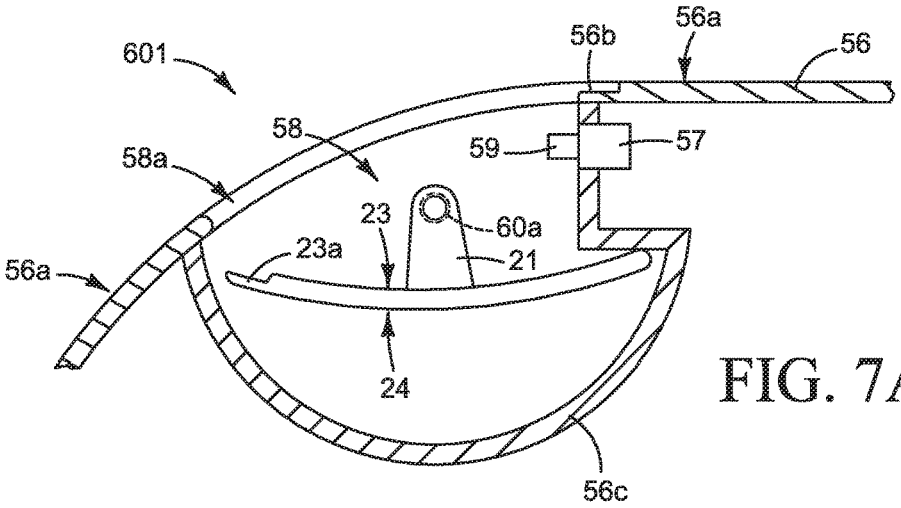
FIG. 7A is a cross-sectional view illustrating the printing apparatus of FIG. 6 including the door in an open position according to an example.
Figure 7B:
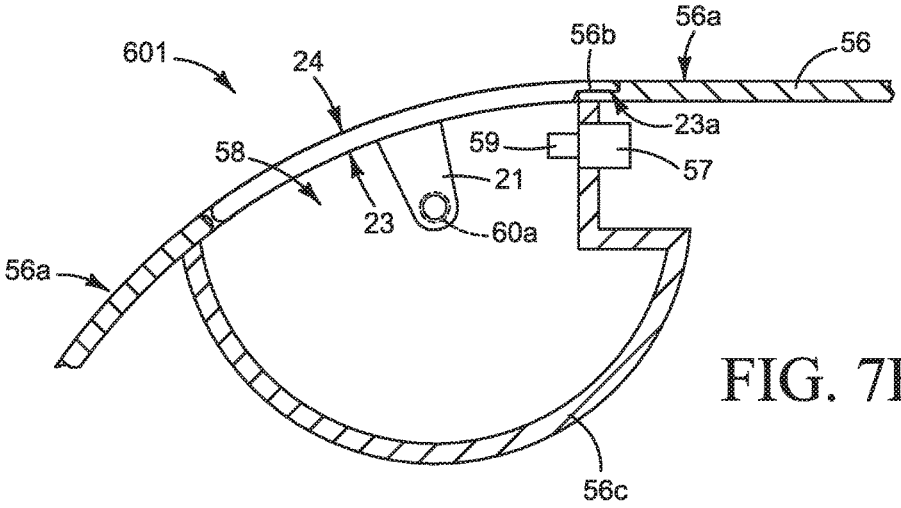
FIG. 7B is a cross-sectional view illustrating the printing apparatus of FIG. 6 including the door in a closed position according to an example.
Figure 7C:
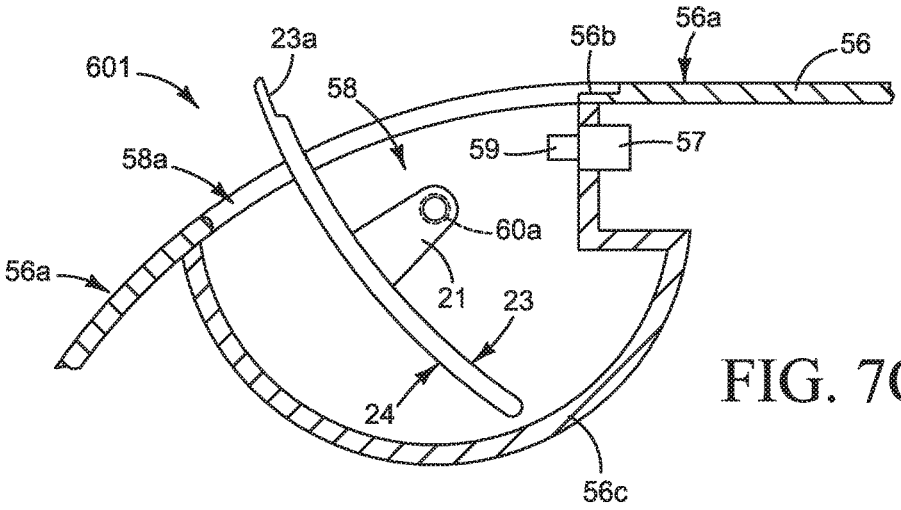
FIG. 7C is a cross-sectional view illustrating the printing apparatus of FIG. 6 including the door in an intermediate position according to an example.
Figure 7D:
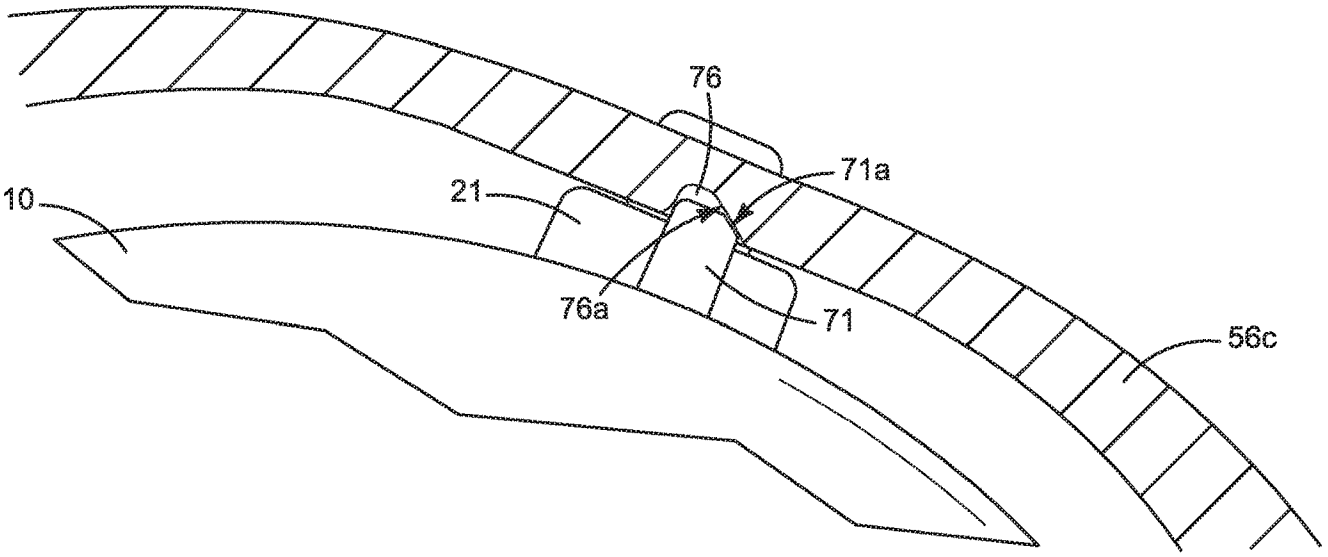
FIG. 7D is a schematic view illustrating the door of the printing apparatus of FIG. 6 according to an example.
Figure 8:
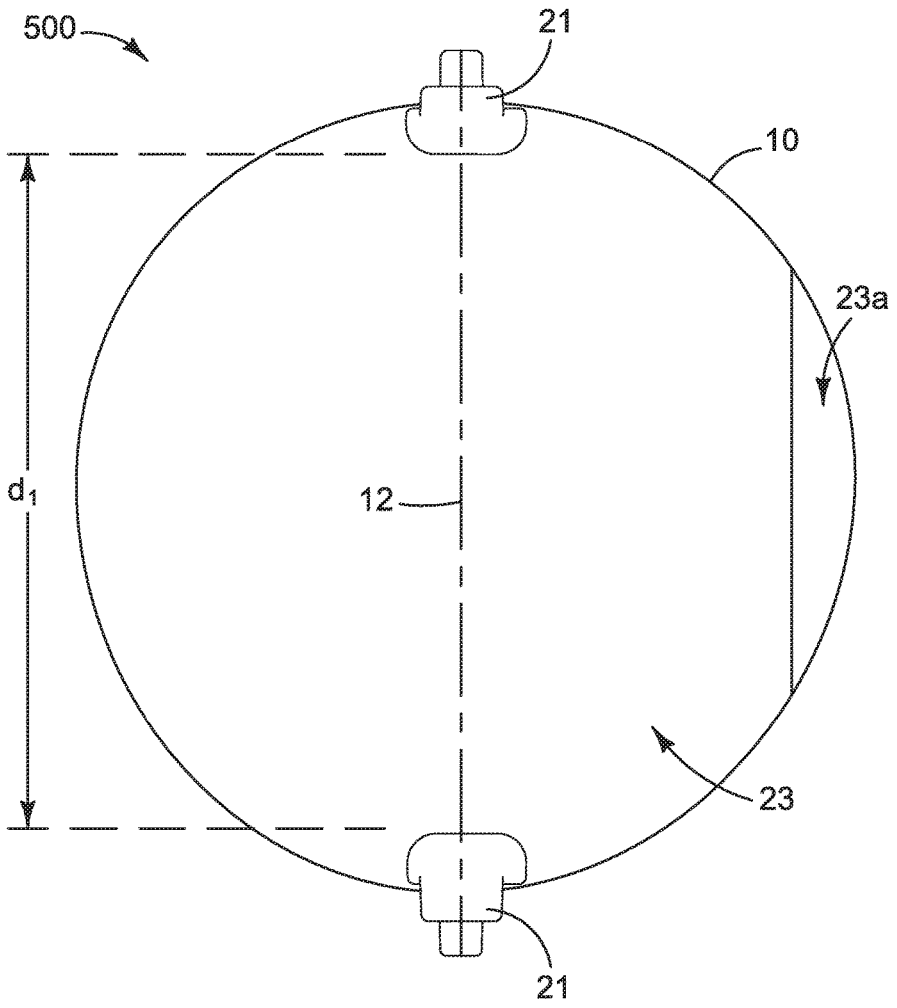
FIG. 8 is a rear view illustrating a door of an access device of the printing apparatus of FIG. 6 according to an example.

FIG. 6 is perspective view illustrating a printing apparatus including a door in an open position according to an example. FIG. 7A is a cross-sectional view illustrating the printing apparatus of FIG. 6 including the door in an open position according to an example. FIG. 7B is a cross-sectional view illustrating the printing apparatus of FIG. 6 including the door in a closed position according to an example. FIG. 7C is a cross-sectional view illustrating the printing apparatus of FIG. 6 including the door in an intermediate position according to an example. FIG. 7D is a schematic view illustrating the door of the printing apparatus of FIG. 6 according to an example. FIG. 8 is a rear view illustrating a door of an access device of the printing apparatus of FIG. 6 according to an example. In some examples, the printing apparatus 601 may include the main body 56, the electrical connector 57, and the access device 500 as previously discussed with respect to the printing apparatus 501 of FIG. 5.

Referring to FIGS. 6-8, in some examples, the main body 56 includes a curved liner member 56*c*, holes 60*a*, and a compartment 58 having an access opening 58*a*. The access device 500 includes a door 10 rotatable between a closed position and an open position. In the closed position, the door 10 covers the access opening 58*a* of the compartment 58. In the open position, the door 10 uncovers the access opening 58*a* of the compartment 58 to enable a user to access an inside of the compartment 58. In the intermediate position (FIG. 7C), the door 10 is located between the open position and the closed position. In the intermediate position, for example, a portion of the door 10 is outside of the compartment 58 and another portion of the door 10 is inside the compartment 58.

An electrical connector 57 such as a card slot to receive an electronic device 59 such as a memory device may be proximate to the compartment 58. That is, a port to the electrical connector 57 may be accessed through the compartment 58. For example, a user may be able to insert the electronic device 59 such as a memory device into and remove the memory device from the electrical connector 57 in the compartment 58 when the door 10 is in the open position. In some examples, the electrical connector 57 may be positioned to receive the electronic device 59 perpendicular to the access opening 58*a*. Further, the user may place the door 10 in the closed position to reduce access to and dust from accumulating on the electrical connector 57 and/or the electronic device 59 such as a memory device.

In some examples, the compartment 58 may include a plurality of electrical connectors 57 such as storage device (SD) card slots and universal serial bus (USB) ports may be proximate to the compartment 58. The door 10 may also be placed in the closed position to provide a flush arrangement with respect to the door 10 and the main body 56. That is, in a flush arrangement between the door 10 and the main body 56, the shape of the main body 56 may be continued across the outer surface 24 of the door 10. For example, the transition between the outer surfaces 23 and 56*a* of the main body 56 and door 10 along the printing apparatus 601 is smooth.

Referring to FIGS. 6-8, in some examples, the door 10 includes a circular shape, an inner surface 23, an outer surface 24, a plurality of connectors 21, and a central axis 12 disposed along a diameter of the door 10. The inner surface 23 may have a concave shape to face inwards toward the compartment 58 in the closed position. The outer surface 24 may have a convex shape to face outwards away from the compartment 58 in the closed position. In some examples, the central axis 12 may correspond with an apex of the outer surface 24 of the door 10.

The connectors 21 may be in a form of an angled member 25 (FIG. 4) spaced apart from each other and extending away from the inner surface 23 of the door 10. The angled member 25 may include an end 25*a* (FIG. 4) to insert into the respective hole 60*a* of the main body 56, and also rotate therein corresponding to a rotation of the door 10. For example, the respective holes 60*a* may be formed in the curved liner member 56*c* of the main body 56. A portion of the curved liner member 56*c* may be shaped to allow sufficient clearance during rotation of the door 10 between the open position and the closed position. In some examples, the plurality of connectors 21 may be removable from the main body 56.

Referring to FIGS. 6-8, in some examples, the connectors 21 may be disposed on the inner surface 23 of the door 10 to movably connect to the main body 56 and be spaced apart from each other by a distance $d_1$ about equal to a diameter of the door 10. That is, the connectors 21 may extend from the inner surface 23 and be located proximate to a circumference of the door 10 by opposite ends of the inner surface 23. The arrangement and movable connection of the connectors 21 to the main body 56, enable the door 10 to rotate about a central axis 12 along a diameter of the door 10. In some examples, a revolving aspect of the door 10 about the central axis 12 provides sufficient cam action right upon closing of the door 10 to the main body 56 in the closed position. In some examples, a respective connector 21 may include a detent portion 71 extending there from to engage a corresponding recess of the main body such as the curved liner member 56*c* to receive the detent portion 71 when the door 10 is placed in the closed portion. That is, when a user rotates the door 10 into the closed position, a detent slanted surface 71*a* may contact and be guided further into the corresponding recess 76 in a closing direction de by a recess sloped surface 76*a*. In some examples, the plurality of connectors 21 may be removable from the main body 56.

Referring to FIGS. 6-8, in some examples, the main body 56 also includes a stop portion 56*b* extending towards the access opening 58*a*. Additionally, the inner surface 23 of the door 10 may also include a stop region 23*a* to contact the stop portion 56*b* in the closed position. The stop portion 56*b* may be offset and/or recessed with respect to other portions of the main body 56. Also, the stop region 23*a* may be offset and/or recessed with respect to other sections of the inner surface 23 of the door 10. Thus, the outer surface 24 of the door 10 may be flush with an outer surface 56*a* of the main body 56 in response to contact between the stop region 23*a* and the stop portion 56*b* in the closed position.

Figure 9:
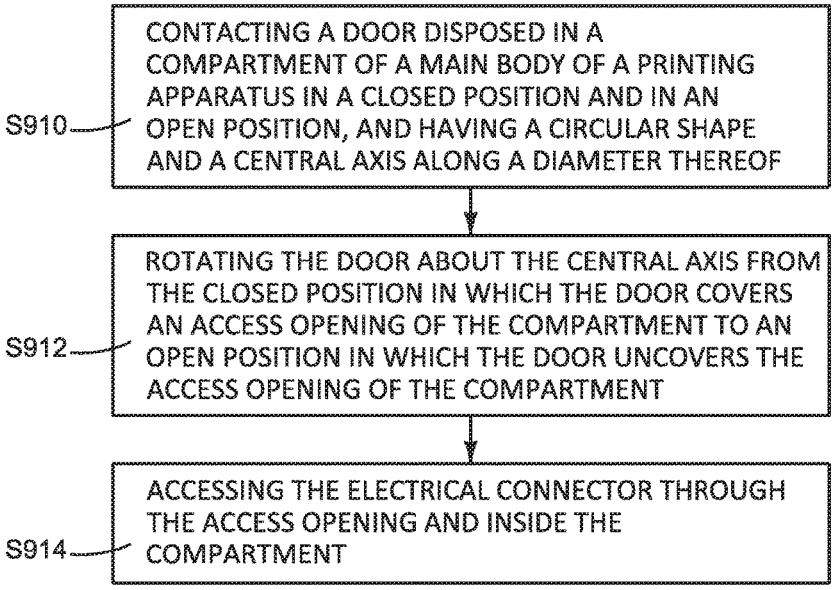
FIG. 9 is a flowchart illustrating a method of accessing an electrical connector of a printing apparatus according to an example.

FIG. 9 is a flowchart illustrating a method of accessing an electrical connector of a printing apparatus according to an example. In some examples, the modules, assemblies, and the like, previously discussed with respect to the access devices 100, 200, and 500 and/or printing apparatuses 501 and 601 of FIGS. 1-8 may be used to implement the method of FIG. 9. Referring to FIG. 9, in block S910, a door disposed in a compartment of a main body of a printing apparatus in a closed position and in an open position is contacted in which the door has a circular shape and a central axis along a diameter thereof. For example, a user may touch the door. In block S912, the door is rotated about the central axis from the closed position in which the door covers an access opening of the compartment to an open position in which the door uncovers the access opening of the compartment. For example, a user may push the door to rotate it from the closed position to the open position.

In some examples, rotating the door about the central axis from the closed position to the open position may include a portion of the door being moved outside of the compartment and, subsequently, the portion of the door being placed back into the compartment. That is, during the intermediate position, a portion of the door may be outside the compartment. In block S914, the electrical connector is accessed through the access opening and inside the compartment. For example, the electrical connector may include a card slot to removable receive an electronic device such as a memory device. In some examples, the electrical connector may be positioned proximate to the compartment to receive the electronic device perpendicular to the access opening. For example, a user may push the door to rotate it from the closed position to the open position. The method may also include rotating the door about the central axis from the open position to the closed position such that a stop region of the door contacts a stop portion of the main body to place the door in the closed position.

In some examples, the door may include an inner surface, an outer surface, and a plurality of connectors. The inner surface may include a concave shape to face inwards toward the compartment in the closed position. The outer surface may include a convex shape to face outwards away from the compartment in the closed position. The connectors may be disposed on the inner surface of the door to movably connect to the main body and be spaced apart from each other by a distance about equal to a diameter of the door. That is, the connectors may be located proximate to a circumference of the door and and by opposite ends of the inner surface. The arrangement and movable connection of the connectors to the main body enable the door to rotate along a central axis along a diameter of the door.

It is to be understood that the flowchart of FIG. 9 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 9 illustrates a specific order of execution, the order of execution may differ from that which is depicted. For example, the order of execution of two or more blocks may be rearranged relative to the order illustrated. Also, two or more blocks illustrated in succession in FIG. 9 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. An access device usable with an electronic device, the access device comprising:

a door rotatable between a closed position to cover an access opening of a compartment of a main body of the electronic device and an open position to uncover the access opening of the compartment to enable a user to access an inside of the compartment, the door including a plurality of connectors to movably connect to the main body to enable the door to rotate about a central axis thereof, the plurality of connectors extending from an inner surface of the door and spaced apart from each other, and an angled member extending from the inner surface of the door having an end to insert into a respective hole of the main body; and wherein the door is to reside within the compartment in the open position and the closed position.

2. The access device of claim 1, wherein the door in its entirety is to reside within the compartment in the open position and the closed position.

3. The access device of claim 1, wherein the door includes an inner surface having a concave shape to face inwards toward the compartment in the closed position and an outer surface having a convex shape to face outward from the compartment in the closed position.

4. The access device of claim 1, wherein the door des a cider shape and the central axis is disposed along a diameter of the door.

5. A printing apparatus, comprising:

a main body including a compartment having an access opening;

at least one electrical connector disposed proximate to the compartment, the at least one electrical connector to receive an electronic device by a user; and an access device including:

a door having a circular shape rotatable between a closed position to cover the access opening of the compartment and an open position to uncover the access opening of the compartment to enable a user to access the at least one electrical connector, the door including an inner surface, an outer surface and a plurality of connectors;

the inner surface having a concave shape to face inwards toward the compartment in the closed position, and an angled member extending from the inner surface of the door having an end to insert into a respective hole of the main body;

the outer surface having a convex shape to face outwards away from the compartment in the closed position; and the connectors to movably connect to the main body to enable the door to rotate about a central axis thereof corresponding to a diameter of the door; and wherein the door is to reside within the compartment in the open position and the closed position.

6. The printing apparatus of claim 5, wherein the outer surface of the door is flush with respect to an outer surface of the main body.

7. The printing apparatus of claim 5, wherein the plurality of connectors extends from the inner surface of the door and are spaced apart from each other by a distance about equal to a diameter of the door.

8. The printing apparatus of claim 5, wherein the main body further comprises a stop portion extending towards the access opening and the inner surface of the door includes a stop region to contact the stop portion in the closed position.

9. A method of accessing an electrical connector of a printing apparatus, the method comprising:

contacting a door disposed in a compartment of a main body of the printing apparatus in a closed position and in an open position, and having a circular shape and a central axis along a diameter thereof;

rotating the door about the central axis from the closed position in which the door covers an access opening of the compartment to an open position in which the door uncovers the access opening of the compartment, wherein the rotating the door about the central axis comprises rotating the door about the central axis from the closed position to the open position in which a portion of the door is moved outside of the compartment and subsequently is placed back into the compartment; and accessing the electrical connector through the access opening and inside the compartment.

10. The method of claim 9, wherein the door includes an inner surface having a concave shape to face inwards toward the compartment in the closed position and an outer surface having a convex shape to face outwards away from the compartment in the closed position.

11. The method of claim 9, wherein the door further comprises:

a plurality of connectors disposed on the inner surface of the door to movably connect to the main body and spaced apart from each other by a distance about equal to a diameter of the door.

* * * * *